US006359594B1

(12) United States Patent
Junod

(10) Patent No.: US 6,359,594 B1
(45) Date of Patent: Mar. 19, 2002

(54) LOOP ANTENNA PARASITICS REDUCTION TECHNIQUE

(75) Inventor: Philippe Junod, Romanel-sur-Morges (CH)

(73) Assignee: Logitech Europe S.A., Romanel-sur-Morges (CH)

( * ) Notice: Subject to any disclaimer, the term of this patent is extended or adjusted under 35 U.S.C. 154(b) by 0 days.

(21) Appl. No.: 09/452,567

(22) Filed: Dec. 1, 1999

(51) Int. Cl.[7] ..... H01Q 1/24
(52) U.S. Cl. ..... 343/744; 343/702
(58) Field of Search ..... 343/741, 743, 343/744, 745, 748, 859, 866, 702, 718, 713, 821

(56) References Cited

U.S. PATENT DOCUMENTS

| | | | | |
|---|---|---|---|---|
| 3,623,110 A | | 11/1971 | Doi et al. | 343/722 |
| 4,630,061 A | * | 12/1986 | Hately | 343/749 |
| 4,814,776 A | | 3/1989 | Caci et al. | 343/702 |
| 4,999,641 A | | 3/1991 | Cordery et al. | 343/742 |
| 5,068,672 A | * | 11/1991 | Onnigian et al. | 343/859 |
| 5,258,766 A | | 11/1993 | Murdoch | 343/742 |
| 5,422,650 A | * | 6/1995 | Hill | 343/713 |
| 5,485,166 A | * | 1/1996 | Verma et al. | 343/744 |
| 5,767,813 A | * | 6/1998 | Verma et al. | 343/744 |
| 5,784,032 A | * | 7/1998 | Johnston et al. | 343/702 |
| 5,826,178 A | | 10/1998 | Owen | 455/193.1 |
| 5,945,958 A | | 8/1999 | Staufer et al. | 343/728 |

FOREIGN PATENT DOCUMENTS

| | | | |
|---|---|---|---|
| DE | 8814993.5 | 3/1989 | H03J/3/20 |
| DE | 4218635 A1 | 12/1993 | G01R/33/34 |
| JP | 79105729 | 8/1979 | H03H/7/38 |
| JP | 7-99345 | 4/1995 | |
| WO | WO 97/01197 | 1/1997 | H01Q/11/12 |
| WO | WO 00/26989 | 5/2000 | H01Q/7/00 |

OTHER PUBLICATIONS

Translation of Tadatsu JP 5–152609/1993.

* cited by examiner

*Primary Examiner*—Don Wong
*Assistant Examiner*—Chuc D. Tran
(74) *Attorney, Agent, or Firm*—Fenwick & West LLP

(57) ABSTRACT

An antenna circuit and matching technique that cancels the inductive reactance of an antenna and thereby reduces the reactive voltage of the antenna are provided. Serial tuning capacitors are inserted along the conductor of the loop antenna as often as necessary to achieve a negligible instantaneous level of reactance on the antenna. The loop antenna is broken up into loop segments, where each segment may or may not have a serial capacitor depending on the desired performance criteria. Each capacitor is selected so as to have a reactance that effectively cancels the inductive reactance of a portion of the loop segment preceding the corresponding serial capacitor. The advantage is that the instantaneous level of reactance on antenna stays nulled, and thus any reactive voltage difference between loop segments remains negligible, even with high current flowing inside the antenna. Parasitics such as ohmic losses, internal capacitive loss and capacitive loss to the external world are all reduced. Moreover, the selected serial tuning capacitors are placed along the antenna wire to effect an average reactive voltage of substantially 0 volts across the antenna. The antenna is thus balanced about GND. Principles of reciprocity regarding passive antennas apply, so both transmitting and receiving antenna configurations are applicable.

20 Claims, 8 Drawing Sheets

LOOP ANTENNA PARASITICS REDUCTION TECHNIQUE

BACKGROUND OF THE INVENTION

1. Field of Invention

This invention relates to antennas and more specifically, to an antenna circuit and matching technique for optimizing small loop antenna performance.

2. Description of the Related Art

Small loop antennas are commonly used in many applications because of their sharply defined radiation pattern, small size and performance characteristics. For example, a cordless keyboard and receiver can be implemented with small loop antennas. When designing a loop antenna, one must consider the effect of certain parasitic elements. In particular, ohmic losses and the capacitive reactances can have the effect of lowering the performance of the antenna for many reasons. Specifically, the ohmic losses can directly reduce the antenna maximum efficiency as measured by the equation: eff=Rr/R1, where Rr is the radiation resistance and R1 is the ohmic loss of the antenna. As can be seen, the greater the ohmic loss of the antenna (R1), the lower the antenna efficiency.

Parasitic capacitances, on the other hand, can effectively create reactive pathways between the loop segments of a loop antenna, or between the turns of a multiple loop antenna. The result is that a portion of the performance current delivered to the antenna is directed between the loop segments or turns that comprise the conductor of the antenna instead of flowing along the conductor of the antenna for maximum magnetic flux generation. Thus, optimal radiation is not achieved. In addition to these ohmic and capacitive losses, the self-resonant frequency of the loop antenna may be lower than the actual desired operating frequency. Such a situation can also lead to significant losses as well as require complicated compensation techniques.

Another less known parasitic of the loop antenna is its capability to generate reactive voltages that are associated with the conductor surface of the antenna. These reactive voltages give life to capacitive leakage currents to surrounding environment conductors typically grounded. These capacitive leakage currents to other environments particularly occur at RF frequencies, and effectively create a capacitive radiating element or capacitive antenna. The radiating pattern of this parasitic capacitive antenna then interacts with the radiating pattern of the small loop antenna and potentially degrades the desired antenna performance. To complicate this mater, changes in the surrounding grounded environment conductors cause corresponding changes in the radiating pattern of the capacitive antenna thereby further disturbing the small loop antenna range. Consequently, the reliability of the small loop antenna is subject to variations in the surrounding environment conductors. This is an unacceptable circumstance in many applications because the performance of the antenna is unpredictable and unreliable.

A particular scenario where the problem of capacitive leakage currents is exacerbated is when a radio device is connected to a cable and the cable runs across the field of operation of the small loop antenna. For example, where a receiver unit is connected to a host computer via a cable, and the cable runs across the transmission field of a cordless mouse. The position of the cable, as well as other grounded devices in the vicinity of the small loop antenna, will affect the spurious capacitance of the parasitic capacitive antenna and ultimately change the radiation pattern of the inductive small loop antenna. In short, both antennas, the desired small loop antenna and the unwanted spurious capacitive antenna, will have their radiation patterns summed vectorially. This is undesirable because the vectorial summing contributes to unpredictable antenna performance. Although it is possible that some configurations may actually increase the desired antenna performance, such configurations are merely fortuitous and simply unreliable. Moreover, the opposite result is likely to occur where antenna performance is dramatically reduced. Regardless, the direct consequence is a random variation of the operating range of the small loop antenna. Such a consequence directly limits the application of the antenna because reliability of the antenna is marginal.

Thus, there are many reasons to correctly control and reduce the various parasitic elements of an antenna. One device available for reducing the parasitic capacitive antenna effect to surrounding environment conductors is called a balun (acronym for balance-unbalanced). This device is designed with lumped elements such as transformer devices or striplines, the length of which is a part of the wavelength of the antenna. These balun devices are not always practical, however, because they can be physically large as well as costly. Moreover, such a device does not prevent antenna current from flowing between the loop segments of a loop antenna, and therefore does not optimize magnetic flux generation. Nor does the balun reduce ohmic losses. To the contrary, a balun adds extra losses in the antenna matching circuit, and can require complex tuning procedures.

Shielding the small loop antenna is also a well-known technique that increases the coupling of the loop antenna to the shield ground and thus prevents the electrical field to radiate externally to other grounded devices in the vicinity of the small loop antenna system. However, this solution is not practical for printed circuit board-type loop antennas because of the physical layout of the antenna on the printed circuit board. This technique is therefore materially limited in its application. Moreover, shielding tends to increase capacitive losses of the small loop antenna reducing its effective field of performance.

Therefore, what is needed is an antenna circuit and matching technique for balancing a loop antenna resulting in canceling the effects of the parasitic elements of the antenna. This technique must be usable for very small antennas including printed circuit board (PCB) applications, and must not require the addition of bulky components. The resulting antenna must be balanced about ground, and have a negligible reactive voltage difference between corresponding points of adjacent turns of the antenna. Moreover, the antenna must be immune to environment conditions, and must provide reliable performance at a reasonably low cost.

BRIEF SUMMARY OF THE INVENTION

Accordingly, the present invention provides an antenna circuit that has an average reactive voltage of substantially 0 volts and is therefore balanced about ground. Additionally, for an antenna that has multiple turns, the reactive voltage difference between corresponding points of the adjacent turns is also substantially 0 volts. The present invention also provides an antenna matching technique that produces an antenna that has an average reactive voltage of 0 volts, and a negligible difference between corresponding points of the adjacent turns of the antenna loop. The antenna matching technique cancels the reactive voltage of the antenna conductor inside the antenna rather than canceling the reactive voltage at the antenna ends by appending a matching circuit.

Specifically, serial tuning capacitors are inserted along the small loop antenna wire as often as necessary. The loop antenna is broken up into loop segments, where each segment may or may not have a serial capacitor depending on the desired performance criteria. A loop segment may be one section of a single turn loop antenna, or one turn of a multiple turn loop antenna. Any number of loop segment resolutions can be implemented depending on the particular application. Each capacitor is selected so as to have a reactance that effectively cancels the inductive reactance of the loop segment preceding the corresponding serial capacitor. The advantage is that the instantaneous level of reactance on antenna stays nulled, and thus any reactive voltage difference between loop segments remains negligible, even with high current flowing inside the antenna. Moreover, the selected serial tuning capacitors are placed along the antenna wire to effect an average reactive voltage of substantially 0 volts across the antenna. The antenna is thus balanced about ground (GND).

The way that a loop antenna radiates power is not related to its voltage but to its current. In short, the reactive voltage on the antenna surface actually disturbs the electromagnetic radiation pattern more than it sustains it. Thus, an initial concern of an antenna matching technique should be to cancel the reactance of the antenna and thereby reduce the reactive voltage across the antenna A low reactive antenna voltage translates to a reduction in the amount of antenna current escaping to external world grounds. A direct consequence of this reduction is a reduction in spurious capacitive radiation. In addition, the power at the self-resonating frequency of the antenna is increased as the overall spurious capacitance is reduced (i.e., antenna radiation is optimized because of maximum magnetic flux generation). Furthermore, the capacitive radiating antenna that is born from the capacitive leakage currents flowing to the surrounding environment grounds is inhibited because the electrical field in between loops is reduced. As a result, the overall ohmic loss of the antenna is reduced, particularly in antennas having multiple turn coils.

Adding too many capacitors is not practical even for loops printed on a PCB. There is a limit where the cumulative capacitance value becomes too large. Rather, the losses due to the equivalent series resistance (ESR) of added capacitors become significant. However, by carefully choosing the tuning capacitor values as well as the placement of each tuning capacitor within the antenna, the antenna will be balanced to ground and optimized for parasitic and ohmic losses reduction.

Thus, the present invention both balances the loop antenna to ground and reduces loop antenna parasitics by selectively placing tuning capacitors inside the coil of the small loop antenna. Parasitics such as ohmic losses, internal capacitive loss and capacitive loss to external world grounds are all reduced by the invention. The result is a highly versatile and reliable small loop antenna that has many applications including PCB applications in an electronically noisy environment. Under the principles of reciprocity, the present invention can be used to balance both transmitting and receiving antennas.

DETAILED DESCRIPTION OF THE INVENTION

Figure 6A:
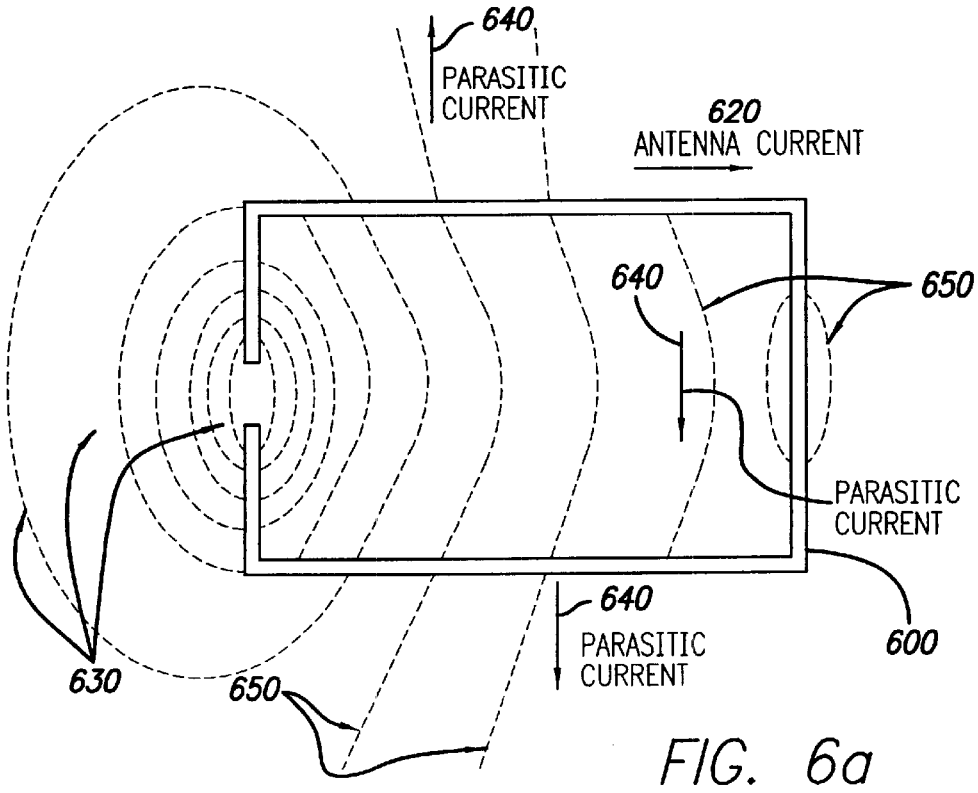
FIG. 6*a* shows the effects of a parasitic capacitance in between the segments of a single loop antenna.

Before discussing exemplar embodiments of the present invention, various loop antenna parasitics and their effect on loop antenna performance will be explained. FIG. 6*a* shows the effects of a parasitic capacitance in between the segments of a single loop antenna. Loop antenna 600 is excited with a voltage source not shown on the drawing. As such, antenna current 620 develops in the loop antenna. As a result, an electrical field 630 develops as shown. However, a parasitic current 640 will flow in is through electrical field 630. This is a capacitive current that will have negative impacts on loop antenna. For example, parasitic current 640 will leave the blue trace and will be lost for loop antenna radiation. Moreover, The pattern of electrical field 630 will radiate like a parasitic whip antenna that has a magnitude and direction depending on the environmental factors such as hand position and nearby conductive devices.

Figure 6B:
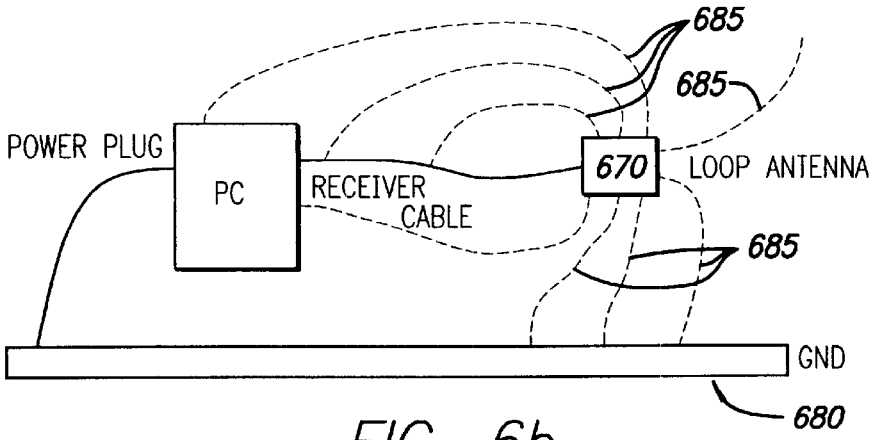
FIG. 6*b* shows the effects of capacitance in between the antenna and the surrounding environment.

FIG. 6*b* shows the effects of capacitance in between the antenna and the surrounding environment. If the voltage on the surface of loop antenna 670 is different than GND 680, an electrical field 685 will develop between antenna 680 and the environment, and in particular the environment conductors connected to GND 680 (ground). This includes all PC related equipments such as cables, peripherals and other plug powered devices. The electrical field 685 will have an associated leakage current and thus give rise to a spurious radiating effect. The magnitude and the sign of the associated currents will depend on the value of the surface voltage on each segment of the antenna. These currents will add parasitic radiating patterns to be combined with the actual loop radiation pattern. Reducing this parasitic antenna can be achieved by reducing the spurious currents. Reducing these currents is possible by (1) reducing the voltage of the antenna segments (currents are proportional to voltages), and (2) having voltage with opposite signs on the corresponding respective antenna segments (such that they cancel each other).

Figure 7A:
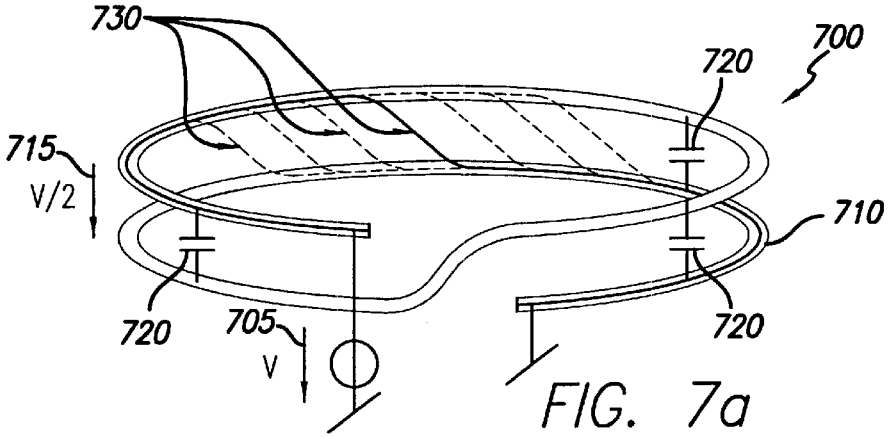
FIG. 7*a* shows the effect of capacitance in between the turns of a multiple loop turn antenna.

FIG. 7*a* shows the effect of parasitic capacitance in between the turns of a multiple turn loop antenna (more than one turn). The embodiment shown represents a two-turn loop antenna 700. When antenna 700 is excited with a voltage 705, antenna current 710 develops. As can be seen, parasitic capacitances 720 between the two turns of the loop antenna will redirect a part 730 of the antenna current 710 so that current 730 will follow the conductor of the antenna for one turn instead of two. The average voltage 715 between the two turns is V/2.

In the particular case where the conductor is working at its self-resonance frequency, half of antenna current 710 will flow through parasitic capacitances 720, and half of antenna current 710 will flow through both turns of the conductor. This is because the reactance of the parasitic capacitor is substantially equal to the reactance of the conductor. Thus half of antenna current 710 will have the efficiency of a two-turn antenna, and half will have the efficiency of only a single turn antenna. The effective turn-number of this antenna will thus be 1.5 instead of 2. The turn number, referred to as N, is important for the radiation resistance ($R_r$) calculation as can be seen in the formula: $R_r=(20(S_aN)^2w^4)/C^4$. A good antenna will thus require parasitic loop capacitance to be minimized.

In addition, in the case where the loop antenna is printed on epoxy, the capacitance between two turns will depend on the dielectric coefficient of the epoxy material. At higher frequencies, the epoxy material may also have significant associated losses. Lowering this parasitic capacitance will further allow the antenna to have less tolerance on the tuned antenna center frequency, and thus less tuning losses. Also, the antenna will have less ohmic losses.

Figure 7B:
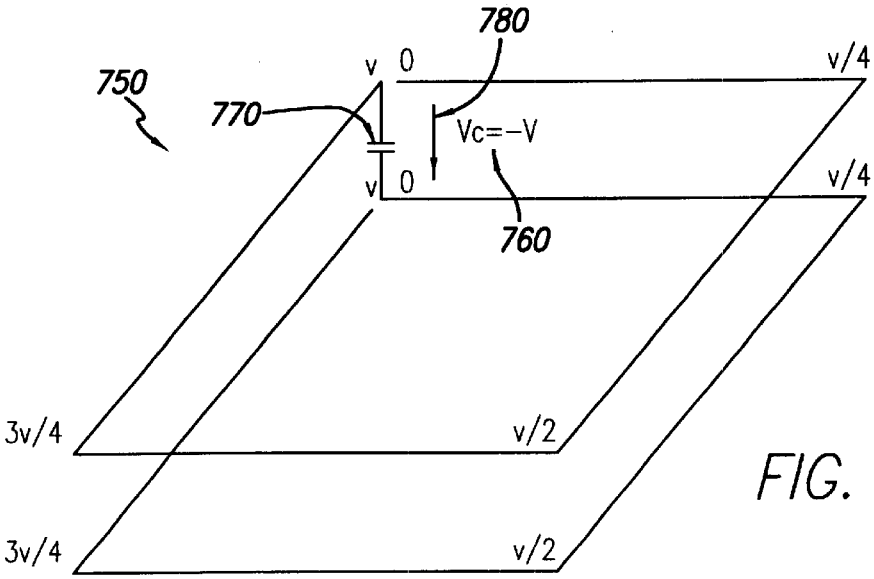
FIG. 7*b* shows a loop antenna having two loop turns where a voltage drop is done once per loop turn of the antenna.

FIG. 7*b* shows a loop antenna 750 having two loop turns where a voltage drop 760 is done once per turn of loop antenna 750 by connecting tuning capacitor 770 in accordance with the present invention. The maximum voltage on loop antenna 750 is doubled while the current 780 in between the two turns is substantially zero as there is no voltage difference between the corresponding points of the respective adjacent turns. Thus, parasitic capacitances are cancelled. In the case where the antenna turns are printed on both sides of a PCB, and the inter-turns parasitic capacitance is cancelled, the antenna sensitivity to the epoxy parameters is greatly reduced.

Figure 1A:
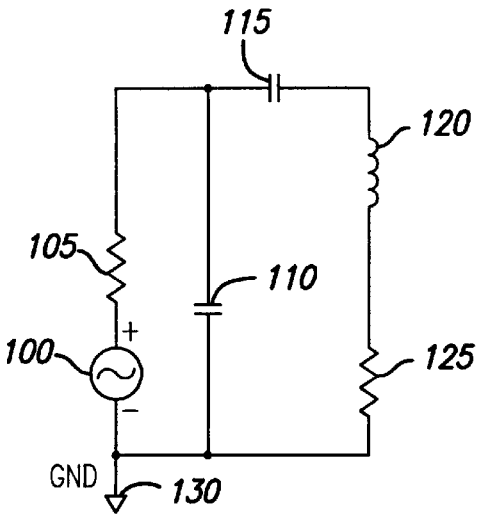
FIG. 1a PRIOR ART
FIG. 1*a* is an electrical schematic of a conventional antenna matching circuit.

Antenna matching will now be discussed. A small loop antenna has an inductive impedance at its operating frequency. Generally, the antenna is tuned to improve its efficiency and selectivity by connecting the antenna to a matching network presenting a capacitive impedance. The matching network is designed such that, at the desired operating frequency, the inductive and capacitive reactances cancel each other. FIG. 1*a* shows an electrical schematic of an antenna matching circuit per conventional standards. Inductor 120 and resistor 125 represent the antenna portion of the circuit. Inductor 120 can be a single turn loop or a multiple turn loop (two or more turns). Resistor 125 represents the overall resistance of the antenna at operating frequency. The reference to overall resistance comprises the DC resistance, the loss resistance due to skin effects, and the radiation resistance. The actual position of resistor 125 in the circuit is not relevant. It simply represents the overall resistance of the antenna. 110 and 115 are tuning capacitors. Source 100, along with source resistance 105, are merely provided to energize the tuned antenna circuit. Capacitors 110 and 115 are selected such that, at the operating frequency of the antenna, they provide a capacitive reactance substantially equal to the inductive reactance of inductor 120. Generally, the capacitive reactance is 180 degrees out of phase with the inductive reactance. As such, the aggregate magnitude of the two reactive impedances is substantially zero. Thus, resistors 105 and 125 represent the only resistance in the antenna while functioning at its operating frequency.

Figure 1B:
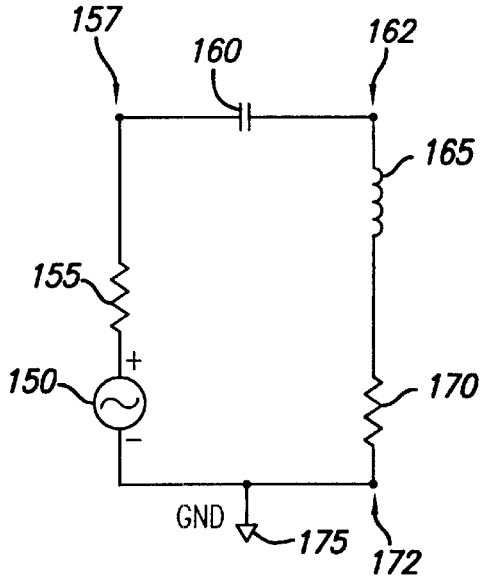
FIG. 1*b* shows the Thevenin equivalent circuit of the antenna matching circuit shown in FIG. 1*a*.

FIG. 1*b* shows the Thevenin equivalent circuit of the antenna matching circuit shown in FIG. 1*a*. This equivalent circuit is provided to simplify discussion. Per Thevenin's theorem, an equivalent circuit comprising a voltage source and an impedance in series can replace any two terminal ac network. Accordingly, the parallel components of capacitor 110 and resistor 105 shown in FIG. 1*a* are transformed into a complex impedance containing resistance 155 and capacitance 111 (capacitance 111 not shown) which are connected in series with source 150, the Thevenin equivalent of source 100. Capacitances 111 and 115 are serial to each other and are represented by capacitance 160 in FIG. 1*b*. As explained above, the capacitive reactance represented by 160 has a magnitude that is substantially equal to, and substantially 180 degrees out-of-phase with, the inductive reactance provided by inductor 165 when the circuit is energized by the operating frequency. Therefore, in a perfectly matched antenna circuit, there is no reactive impedance, and resistance 155 is equal to the overall resistance 170 of the antenna at operating frequency.

Typical antennas present a large quality factor (Q factor) which gives rise to increased voltage on reactive parts of the antenna circuit. For example, one terminal of inductor 165 shown in FIG. 1*b* is connected to ground 175 (GND). Voltage 172 represents the voltage at that point. The voltage on the other terminal of inductor 165 is at voltage 162 which is equal to Q * source 150, where Q is the loaded Q factor of the antenna. The average reactive voltage (Vavg) on the antenna can be represented as (voltage 162–voltage 172)/2, but since voltage 172 is GND 175, the equation can be simplified to (voltage 162)/2. Vavg can also be referred to as the balancing point of the antenna. Voltage 157 represents the voltage between capacitance 160 and resistance 155.

Ideally, all of the antenna current generated by source 150 will flow through the turns of inductor 165 thereby maximizing the magnetic flux generation. As a consequence, the radiation emitting from the antenna is also maximized. However, varying voltages across the loop segments of the antenna gives rise to parasitic capacitances. These capacitances may exist between the turns of inductor 165, or may exist between the antenna surface and grounded objects in the surrounding environment. As a result, a portion of the antenna current flows through these parasitic capacitances rather than flow completely through the turns of inductor 165 (also referred to as the antenna conductor or the antenna wire). For instance, a portion of the antenna current may flow between the turns of inductor 165 rather than completely through the turns of inductor 165. The effect of redirecting a portion of the antenna current through these parasitic capacitances is the reduction of the desired magnetic flux generation as well as the desired radiation from the antenna. Moreover, the difference in potential across the parasitic capacitances referenced to environment grounds creates an electrical field. The electrical field created is essentially a spurious capacitive antenna that has the ability to disturb the desired inductive loop antenna radiation pattern.

Figure 1C:
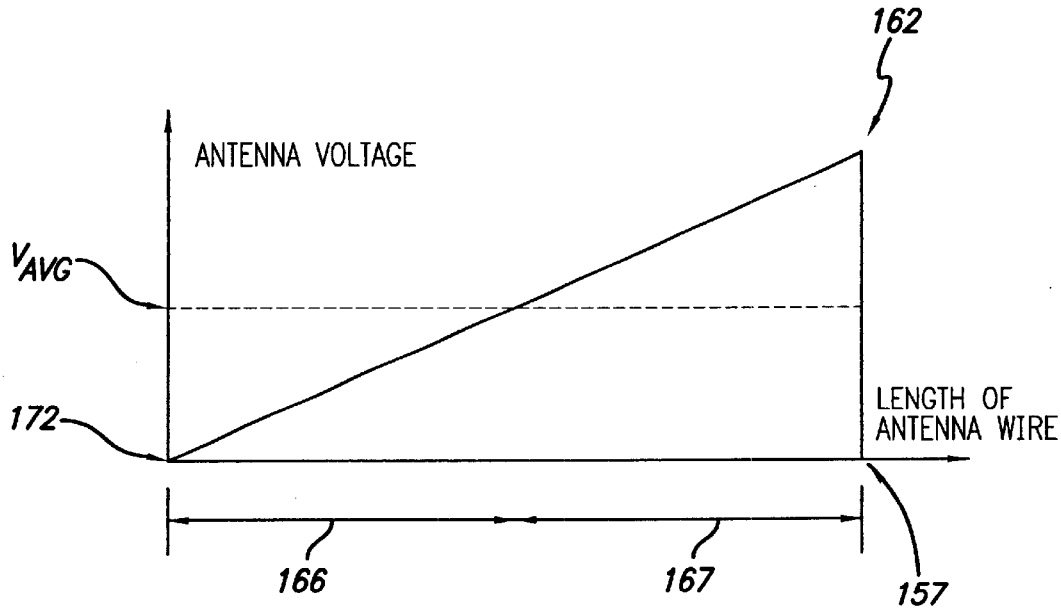
FIG. 1*c* is an antenna voltage distribution graph of the antenna matching circuit shown in FIG. 1*b*.

FIG. 1*c* is an antenna voltage distribution graph of the antenna matching circuit shown in FIG. 1*b*. Voltage 172 is at GND 175. However, as the distance along the antenna wire (inductor 165) increases, the antenna voltage linearly increases as well until voltage 162, where the antenna voltage is at its maximum. The total distance of the loop antenna wire can be calculated by adding the length of loop segment 166 with the length of loop segment 167. The voltage across the antenna is the difference between voltage 162 and voltage 172. The voltage across capacitance 160 is the difference between voltage 162 and voltage 157. In sum, the reactive voltage generated across inductor 165 is absorbed by capacitance 160. Thus, the reactive voltage is canceled and the antenna circuit is matched.

Referring to FIG. 1*c*, the graph depicts inductor 165 as having two loop segments 166 and 167. As stated earlier, Vavg of the antenna is (voltage 162)/2. Thus, this antenna is balanced to (voltage 162)/2 rather than to GND 175 thereby making the antenna susceptible to inefficiency due to parasitic leakage current to surrounding environment grounds. This problem is illustrated in FIGS. 6*a* and 6*b*. Moreover, if the loop segments 166 and 167 represent the first and second turns, respectively, of a two turn loop antenna, then the average reactive voltage between turns is also (voltage 162)/2. As explained earlier, this potential difference between turns ultimately gives rise to reactive pathways between the turns of a multiple loop antenna. The result is that a portion of the performance current delivered to the antenna flows between the loops rather than flowing through the conductor of the antenna. Thus, optimal radiation is not achieved. This problem is illustrated in FIGS. 7*a*.

Figure 2A:
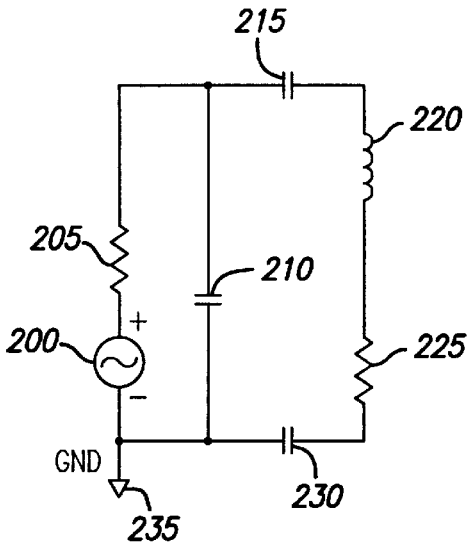
FIG. 2*a* is an electrical schematic of one embodiment of an antenna matching circuit in accordance with the present invention.

The present invention provides a technique to cancel these undesirable parasitic effects as well as to balance the antenna to ground. FIG. 2*a* is an electrical schematic of an antenna matching circuit in accordance with the present invention. Inductor 220 and resistor 225 represent the antenna portion of the circuit. Inductor 220 can be a single turn loop or a multiple turn loop (two or more turns). Resistor 225 represents the overall resistance of the antenna at the operating frequency as explained above. As noted earlier, the actual position of resistor 225 along the antenna is irrelevant. It is included only to show its existence. Source 200, along with source resistance 205, are again simply provided to energize the circuit. Regarding source 200, those skilled in the art will appreciate that although the description of the present invention herein is written with the transmitting antenna in mind, principles of reciprocity make the description equally applicable to receiving antennas. As can be seen, there are three tuning capacitors, capacitor 210, capacitor 215 and capacitor 230. Capacitor 215 is serially connected on one end of inductor 220. Capacitor 230 is serially connected on one the other end of inductor 220. Capacitor 210 is connected across the series combination of capacitor 215, inductor 220 and capacitor 230.

Figure 2B:
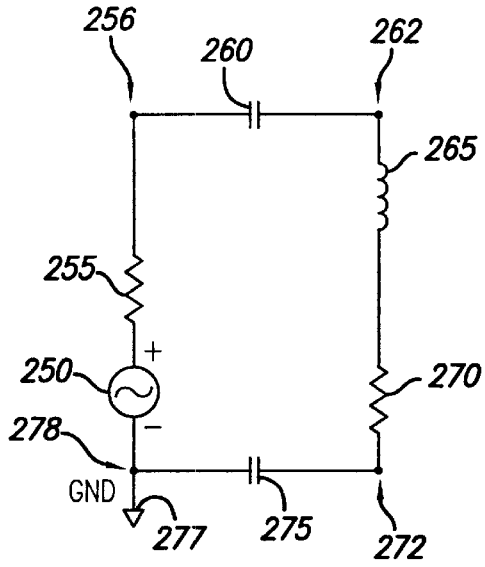
FIG. 2*b* shows the Thevenin equivalent circuit of the antenna matching circuit shown in FIG. 2*a*.

FIG. 2*b* shows the Thevenin equivalent circuit of the antenna matching circuit shown in FIG. 2*a*. Resistor 270 is the overall resistance of the antenna at the operating frequency. The parallel components of capacitor 210 and resistor 205 shown in FIG. 2*a* are transformed into a complex impedance containing resistance 255 and capacitance 211 (capacitance 211 not shown) which are connected in series with source 250, the Thevenin equivalent of source 200. Capacitance 211, capacitance 215 and capacitance 230 are serial to each other and thus can be symbolized as a single capacitive reactance. However, rather than represent the aggregate capacitance of capacitance 211, capacitance 215 and capacitance 230 as one capacitance, it is distributed into two serial capacitances represented by capacitance 260 and capacitance 275 as shown in FIG. 2*b*. In order to achieve substantially the same matching reactance provided by capacitance 160 in FIG. 1*b*, capacitance 260 and capacitance 275 each have a value that is substantially twice the value of capacitance 160 (however, note that capacitor 210 of FIG. 2*a* is substantially equal to capacitor 110 of FIG. 1*a*). Selecting capacitance 260 and capacitance 275 in this manner ensures that the antenna voltage will be balanced about GND 277. Although the total series capacitance is substantially the same in FIGS. 1*b* and 2*b*, it is redistributed (as shown in FIG. 2*b*) so that the average reactive voltage (Vavg) of the antenna is about zero volts (GND 277). Because Vavg is GND, the overall electrical field generation/reception of the antenna will be canceled thereby minimizing the negative parasitic effects of reactive voltages existing on the antenna surface.

It is possible that some applications may require a different, non-symmetrical configuration where capacitance 260 and capacitance 275 are not substantially equal. For example, capacitance 260 and might have a value of 40% of the value of capacitance 160, while capacitance 275 has a value of 60% of the value of capacitance 160. Such a configuration might be necessary where the antenna wire has a non-uniform width for instance. Other percentage breakdowns could be applied as well depending on the desired antenna performance. Thus, asymmetrical balancing is also achievable under the principles of the present invention.

Those skilled in the art will recognize capacitance 260 as the symbolic representation of capacitor 210 and capacitor 215 of FIG. 2*a*, and capacitance 275 as the symbolic representation of capacitor 230 of FIG. 2*a*. As is well understood in the art, a resonant circuit (such as an antenna circuit functioning at its operating frequency) is tuned when the amount of inductive impedance is cancelled by the amount of capacitive impedance. The result is that only purely resistive elements remain while reactive elements are nulled. In the case of FIG. 2*b*, these resistive elements are represented by resistance 255 and resistance 270. For the circuit to be properly matched, these two resistances must substantially equal one another. Thus, the overall capacitance represented by capacitors 210, 215 and 230 is chosen to bring about this affect. A network analyzer may be used to verify the selection of the capacitors. Alternatively, the capacitor values can be calculated manually or with the aid of a computer program. Those skilled in the art will appreciate many methods for determining the amount of the requisite tuning capacitance.

Referring to FIG. 2*b*, voltage 272 represents the voltage between capacitance 275 and one side of inductor 265. Voltage 262 represents the voltage between capacitance 260 and the other side of inductor 265. Voltage 256 represents the voltage between capacitance 260 and source 250. Voltage 278, which is GND 277, represents the voltage between capacitance 275 and source 250. The capacitive and inductive reactances cancel each other at the operating frequency of the antenna, and voltages 256 and 278 are GND.

Figure 2C:
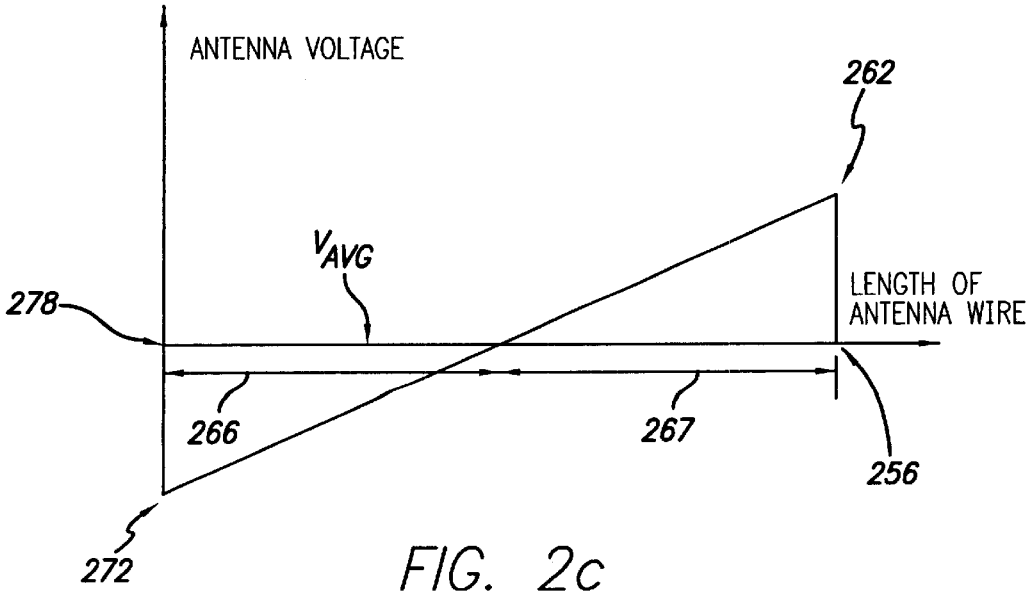
FIG. 2*c* is an antenna voltage distribution graph of the antenna matching circuit shown in FIG. 2*b*.

FIG. 2*c* is an antenna voltage distribution graph of the antenna matching circuit shown in FIG. 2*b*. Voltage 278 is at GND 277. The voltage across capacitance 275 is the difference between voltage 278 and voltage 272, where voltage 272 represents the maximum negative voltage on the antenna. Inductor 265 is broken into two loop segments of 267 and 266 that comprise the length of the antenna wire or radiating surface. As the distance along the antenna wire increases, the antenna voltage linearly increases as well until voltage 262, where the antenna voltage is at its maximum positive voltage. The voltage across the antenna is the difference between voltage 262 and voltage 272. The voltage across capacitance 260 is the difference between voltage 262 and voltage 256. In summary, the voltage on the antenna starts at voltage 278 which is at GND 277. Capacitance 275 provides a voltage drop to voltage 272. The antenna voltage then linearly rises until voltage 262 where capacitance 260 provides a second voltage drop to voltage 256, which is effectively at GND 277. Thus, the antenna is properly matched because the stop and start voltages are at the same potential (GND). Moreover, the antenna is balanced because the average reactive voltage across the antenna is substantially 0 volts.

Referring to FIG. 2*c*, the graph depicts inductor 265 as having two segments 267 and 266. The actual voltage difference on the antenna terminals (i.e. across inductor 265) is calculated as Q* source 250. This is so because even though the reactance of the tuning capacitors has been redistributed, its series effect is generally the same when considering Q. This conclusion is based on the assumption that capacitance 260 and capacitance 275 of FIG. 2*b* is each substantially twice the value of capacitance 160 of FIG. 1*b*. However, the voltage across the antenna shown in FIG. 2*b* is no longer referenced to GND, unlike the antenna of FIG. 1*b*. Rather, the voltage across the antenna is referenced to voltage 272 because the tuning capacitance is split into two components (capacitance 260 and capacitance 275) placed before and after loop segments 267 and 266, respectively, of the antenna.

Vavg of the antenna is (voltage 262+voltage 272)/2. The voltage across capacitance 275 is substantially equal to the voltage across loop segment 266. However, these respective voltages have opposite polarities and thus cancel each other. Similarly, the voltage across capacitance 260 is substantially equal to the voltage across loop segment 267. These respective voltages also have opposite polarities and thus cancel each other. As a result of the cancellations of the voltages both above and below GND 277, Vavg is substantially 0 volts. Accordingly, the balance point of the antenna is substantially at GND 277. Note, however, that the average reactive voltage between loop segments 266 and 267 of inductor 265 is substantially voltage 262. Thus, the capacitance between the loop segments is not cancelled.

Figure 3A:
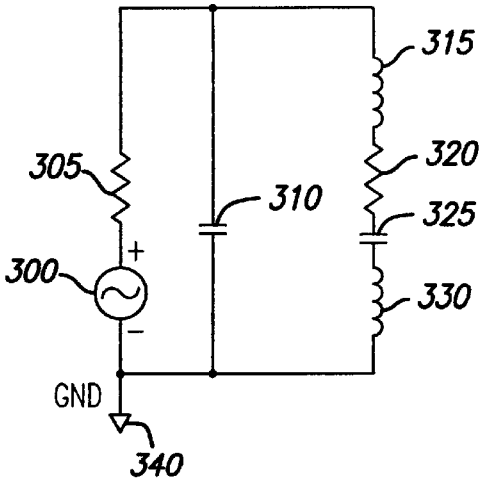
FIG. 3*a* is an electrical schematic of one embodiment of an antenna matching circuit in accordance with the present invention.

FIG. 3*a* is an electrical schematic of an antenna matching circuit in accordance with the present invention. The conductor of the antenna is comprised of loop segment 315 and loop segment 330. The conductor can be a single turn loop or a multiple turn loop (two or more turns). Resistor 320 is symbolic of the overall resistance of the antenna at its operating frequency. Source 300 along with source resistance 305 represents a conventional means to energize the antenna circuit. Capacitor 310 and capacitor 325 are tuning capacitors. Tuning capacitor 310 is connected between the outer ends of loops segments 315 and 330 of the antenna. Tuning capacitor 325 is selectively placed between the inner ends of loop segments 315 and 330 of the antenna and provides a polarity change thereby enabling the balancing and optimizing of the antenna in accordance with one embodiment of the present invention. The values of capacitor 325 and capacitor 310 are determined during the matching calculation and depend upon the ratio of resistor 305 and resistor 320.

One advantage of placing capacitor 325 in between loop segment 315 and loop segment 330 is that no extra serial capacitor has to be added to the antenna. For example, the antenna matching circuit of FIG. 2*a* requires one additional capacitor compared to FIG. 1*a*, while the antenna matching circuit of FIG. 3*a* requires no additional capacitor. Thus, there is the benefit of less loss due to capacitor equivalent series resistance (ESR) that may be beneficial in the case of low loss loop antenna applications.

Figure 3B:
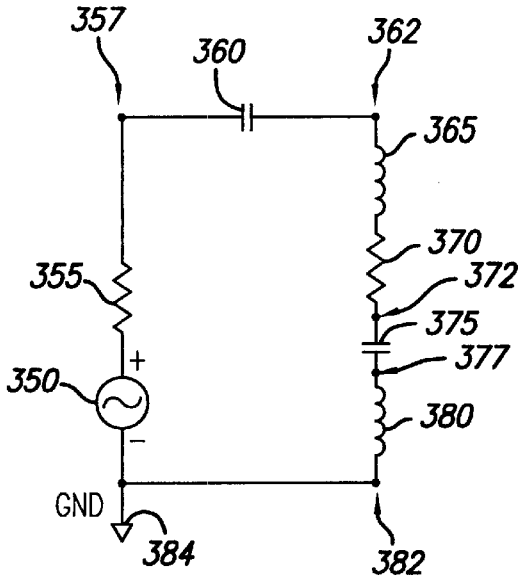
FIG. 3*b* shows the Thevenin equivalent circuit of the antenna matching circuit shown in FIG. 3*a*.

FIG. 3*b* shows the Thevenin equivalent circuit of the antenna matching circuit shown in FIG. 3*a*. Resistor 370 is the overall resistance of the antenna at its operating frequency. The parallel components of capacitor 310 and resistance 305 shown in FIG. 3*a* are transformed into a complex impedance containing resistance 355 and capacitance 360 which are connected in series with source 350, the Thevenin equivalent of source 300. Capacitor 325 is represented by capacitance 375 as shown in FIG. 3*b*. While capacitance 360 is serially connected before loop segment 365, capacitance 375 is selectively connected in series between loop segment 365 and loop segment 380. By placing capacitance 375 between loop segment 365 and loop segment 380 and not at the GND 384 side of loop segment 380, the balancing point of the antenna is shifted.

Referring to FIG. 3*b*, voltage 382 represents the voltage on the GND 384 side of loop segment 380. Voltage 362 is the voltage between one side of loop segment 365 and capacitance 360. Voltage 357 is the voltage between the other side of capacitance 360 and resistance 355. Voltage 377 is the voltage between the other side of loop segment 380 and capacitor 375. Voltage 372 is the voltage between capacitor 375 and the other side of loop segment 365.

Figure 3C:
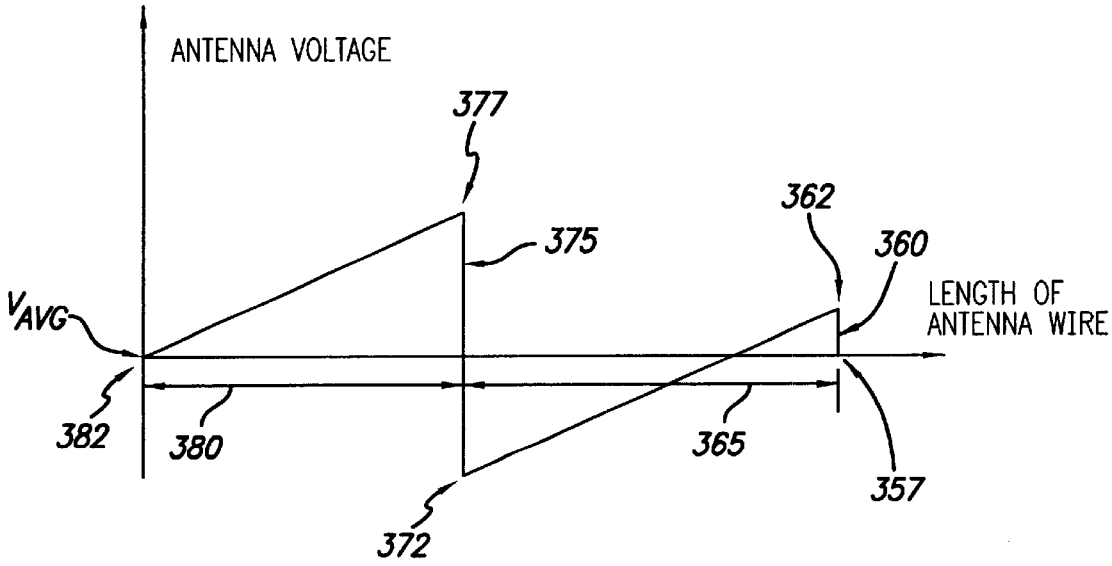
FIG. 3*c* is an antenna voltage distribution graph of the antenna matching circuit shown in FIG. 3*b*.

FIG. 3*c* is an antenna voltage distribution graph of the antenna matching circuit shown in FIG. 3*b*. The antenna conductor is broken into loop segment 365 and loop segment 380 which comprise the length of the antenna wire or radiating surface. Voltage 382 is at GND 384. The voltage across loop segment 380 is the difference between voltage 377 and voltage 382. However, because voltage 382 is GND 384, the equation can be simplified to voltage 377, which represents the maximum positive voltage on the antenna. The voltage across capacitance 375 is the difference between voltage 377 and voltage 372. In this particular embodiment, voltage 372 has a greater magnitude than that of voltage 377 because of the placement of capacitance 375. More specifically, capacitance 375 is placed closer to one end of the antenna wire rather than in the middle of the antenna wire. The actual placement of a tuning capacitor inside the antenna will be discussed in turn. The voltage across loop segment 365 is the difference between voltage 362 and voltage 372. The voltage across capacitance 360 is the difference between voltage 362 and voltage 357. Since voltage 357 is effectively GND, then the voltage across capacitance 360 is voltage 362.

Referring to FIG. 3*c*, the graph depicts the antenna as having loop segment 365 and loop segment 380. Voltage 362 would be 0 volts if the loop segments were equal in length. In such a case, the resulting shape of the voltage distribution graph would be a symmetrical butterfly shape where Vavg was substantially 0 volts. However, capacitance 360 would have to be infinite in value (or capacitor 310 would have to be zero) in order to achieve the symmetrical butterfly shape (i.e., resistance 320 equal to resistance 305). Because such a configuration is not practical, the present invention provides a solution. As tuning capacitance 375 is moved along the antenna wire, the balancing point of the antenna can be adjusted. Vavg is substantially 0 volts in this embodiment. Regardless of symmetry in the voltage distribution graph, one goal of positioning capacitance 375 is to have the same surface area of voltage distribution above GND 384 as there is surface area of voltage distribution below GND 384. Thus, the position of capacitance 375 may be selected as needed to achieve an antenna balanced about GND. Alternatively, and in accordance with Kirchhoff's voltage law, placing additional serial capacitors along the antenna wire can reduce peak voltages 377 and 372 on the antenna.

In one embodiment, an antenna comprised of multiple loop segments can be fabricated on a PCB. The loop segments may be all on one side of the PCB, divided between both the outer sides of the PCB, or divided among the various layers of a multiple layer PCB. A loop antenna fabricated on a PCB is referred to as a printed loop.

With such a printed loop, the process of installing a series capacitor in between loop segments is relatively easy to accomplish by etching away a portion of the conductor comprising the printed loop and connecting in the desired capacitor. The capacitor is connected by solder or other suitable means depending on the application. The loop segments comprising the antenna may also be actual wound inductors having a tuning capacitor serially spliced in between them. Regardless of the embodiment chosen, the position of the tuning capacitor along the antenna wire is selected using the formula, $x/L=1-(w^2*L_a*C_X)/2$, where x is the resulting distance, L is the antenna wire length, w is 2*PIE*Operating Frequency, $L_a$ is the inductor value of the antenna wire, and $C_X$ is the tuning capacitor to be placed inside the loop antenna (for example, $C_X$ is capacitor 325 of FIG. 3*a* or capacitor 375 of FIG. 3*b*). The resulting distance is measured from the GND side of the antenna wire. The units of L control the units of x.

The value of $C_X$ depends on the actual matching impedance of the receiver circuit and the antenna loss resistance. For example, the following formulas is used to determine the value of capacitors 325 and 360 of FIG. 1*a*:

$$c1 = \frac{\left(\omega^2 \cdot L + \sqrt{-R^2 \cdot \omega^2 + Ri \cdot R \cdot \omega^2}\right)}{[\omega^2 \cdot (R^2 + \omega^2 \cdot L^2 - Ri \cdot R)]}$$

$$c2 = -c1 \cdot \frac{(1 - \omega^2 \cdot c1 \cdot L)}{(R^2 \cdot c1^2 \cdot \omega^2 + c1^2 \cdot L^2 \cdot \omega^4 - 2 \cdot \omega^2 \cdot c1 \cdot L + 1)}$$

where c1=capacitor 325, c2=capacitor 310, Ri=resistance 305, R=resistance 320, and L=inductance of the antenna conductor comprised of loop segments 320 and 330. One skilled in the art will recognize that such formulas are not necessary to practice the present invention as other methods of determining the capacitor values can be used, such as Smith chart techniques.

Once $C_X$ is known, x/L can be calculated. The result must be positive and smaller than one. Then, x/L is multiplied by L to obtain the desired location of $C_X$. As an example calculation, consider a square, one turn printed loop antenna having the dimensions of 6 cm by 4 cm and an operating frequency of 27 MHz. L, therefore is 20 PATENT cm (calculated by 2 * (length+width)). Given $L_a$ equals 0.6 uH and $C_X$ equals 18 pf, x/L equals 0.845. Multiplying this result by L then yields 16.892 cm. Thus, $C_X$ should be placed 16.892 cm from the GND end of $L_a$.

Figure 4A:
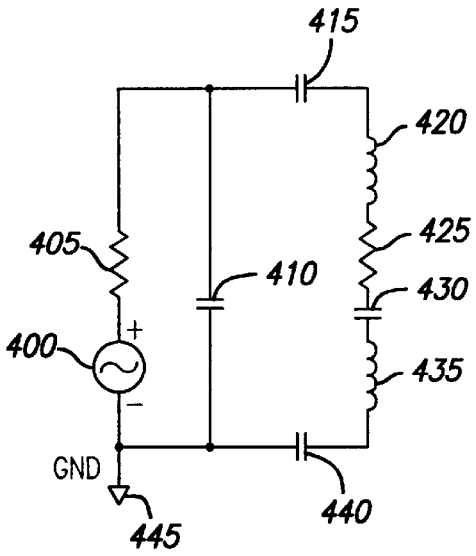
FIG. 4*a* is an electrical schematic of one embodiment of an antenna matching circuit in accordance with the present invention.

FIG. 4*a* is an electrical schematic of yet another antenna matching circuit in accordance with the present invention. A two-turn conductor, comprised of loop segment 420 (loop turn number one) and loop segment 435 (loop turn number 2), and resistor 425 represent the antenna portion of the circuit. Resistor 425 symbolizes the overall resistance of the antenna at its operating frequency. Source 400, along with source resistance 405, are simply provided to energize the circuit. As can be seen, there are four tuning capacitors, capacitor 410, capacitor 415, capacitor 440 and capacitor 430. Capacitor 415 is serially connected to the outer end of loop segment 420. Capacitor 440 is connected to outer end of loop segment 435. Capacitor 430 is connected between the inner ends of loop segment 420 and loop segment 435. Capacitor 410 is connected across the serial combination of capacitor 415, loop segment 420, capacitor 430, loop segment is 435 and capacitor 440.

Figure 4B:
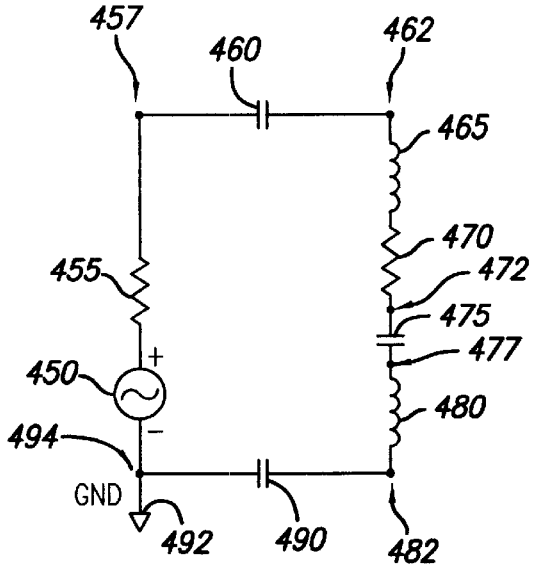
FIG. 4*b* shows the Thevenin equivalent circuit of the antenna matching circuit shown in FIG. 4*a*.

FIG. 4*b* shows the Thevenin equivalent circuit of the antenna matching circuit shown in FIG. 4*a*. Resistor 470 represents the overall resistance of the antenna at its operating frequency. The parallel components of capacitor 410 and resistance 405 shown in FIG. 4*a* are transformed into a complex impedance containing resistance 455 and capacitance 411 (capacitance 411 not shown) which are connected in series with source 450, the Thevenin equivalent of source 400. Capacitance 411, capacitor 415, capacitor 430 and capacitor 440 are serial to each other and thus can be symbolized as a single capacitive reactance as previously explained. However, rather than represent their aggregate serial capacitance as one capacitance, it is distributed into three serial capacitances represented by capacitance 460, capacitance 490 and capacitance 475 as shown in FIG. 4*b*. In this embodiment, capacitance 460 and capacitance 490 are substantially equal in value and each has a capacitance that is substantially twice the capacitance value of capacitance 475. Note, however, that capacitance 475 represents substantially one half of the capacitive reactance of the antenna matching circuit. Accordingly, capacitance 475 also represents one half of the inductive reactance of the antenna.

Figure 4C:
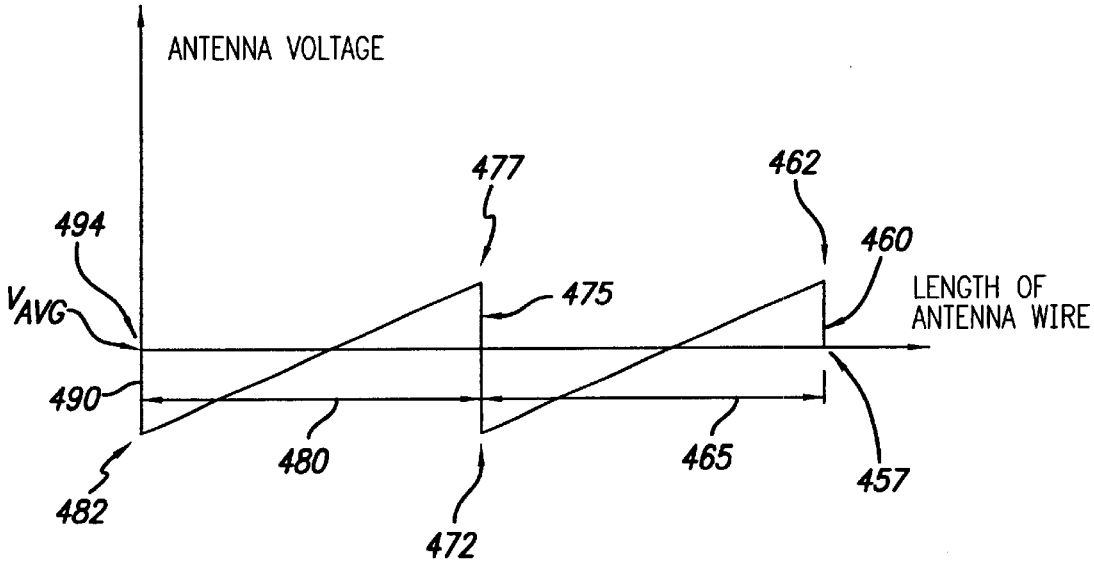
FIG. 4*c* is an antenna voltage distribution graph of the antenna matching circuit shown in FIG. 4*b*.

Generally, such selection of capacitance 460, capacitance 490 and capacitance 475 ensures that the antenna voltage will not only be balanced about GND 492, but also will have a voltage difference between loop segments 465 and 480 of substantially zero volts. The embodiment disclosed in FIG. 4*a* provides a symmetrical voltage distribution about Vavg as shown in FIG. 4*c*, but as explained earlier, symmetry is not necessary to achieve an antenna balanced about GND. Those skilled in the art will recognize that capacitance 460 of FIG. 4*b* represents capacitors 410 and 415 of FIG. 4*a*. Likewise, capacitances 475 and 490 of FIG. 4*b* represent capacitors 430 and 440, respectively, of FIG. 4*a*.

Referring to FIG. 4*b*, voltage 482 represents the voltage between one side of loop segment 480 and capacitance 490. Voltage 462 is the voltage between one side of loop segment 465 and capacitance 460. Voltage 457 is the voltage between the other side of capacitance 460 and resistance 455. Voltage 477 is the voltage between the other side of loop segment 480 and capacitance 475. Voltage 472 is the voltage between the other side of capacitance 475 and the other side of loop segment 465 Voltage 494 represents the voltage on the GND 492 side of source 450.

FIG. 4*c* is an antenna voltage distribution graph of the antenna matching circuit shown in FIG. 4*b*. Voltage 494 is at GND 492. The voltage across capacitance 490 is the difference between voltage 494 and voltage 482. However, because voltage 494 is GND 494, the equation can be simplified to voltage 482, which represents the maximum negative voltage on the antenna. The antenna conductor is broken into loop segment 465 and loop segment 480 which comprise the length of the antenna wire or radiating surface. As the distance along the antenna wire increases, the antenna voltage linearly increases as well until voltage 477, where the antenna voltage is at its maximum positive voltage. The voltage across loop segment 480 of the antenna is the difference between voltage 477 and voltage 482. The voltage across capacitance 475 is the difference between voltage 477 and voltage 472. The voltage across loop segment 4 65 of the antenna is the difference between voltage 462 and voltage 472. The reactive voltage across capacitance 460 is the difference between voltage 462 and voltage 457.

Several observations can be made about the embodiment represented in FIG. 4*c*. First, capacitance 475 was placed substantially half way along the antenna wire. As a result, loop segment 465 and loop segment 480 are substantially equal in length, each being one half the distance of the total length of the antenna wire. Second, capacitance 460 and capacitance 490 are substantially equal in value and are placed before and after, respectively, the loop segments of the antenna wire. Both capacitance 460 and capacitance 490 provide a polarity change of substantially equal magnitude. Thus, the difference between voltage 494 and voltage 482 is substantially equal to the difference between voltage 462 and voltage 457. Third, capacitance 475 is substantially one half the capacitance value of capacitance 460 or capacitance 490. As a result, the voltage across capacitance 475 is twice that across capacitance 460 or capacitance 490. Fourth, the average reactive voltage (Vavg) of the antenna, or the balancing point of the antenna, is substantially GND 492. That is, the reactive voltage on the antenna has a positive component and a negative component, and the positive component is substantially equal to the negative component. Fifth, loop segment 465 has substantially the same reactive voltage at any given point along its length as the reactive voltage at the corresponding point along the length of loop segment 480. It follows that the reactive voltage difference between loop segments is substantially 0 volts (FIG. 7*b* and corresponding discussion further explain this fifth observation). Sixth, the linear portions of the voltage distribution graph correspond to the voltage across the loop segments, and the polarity changes shown on the voltage distribution graph correspond to the voltage across the tuning capacitors.

Thus, the embodiment of the present invention depicted in FIGS. 4*a*, 4*b* and 4*c* provides an antenna that is balanced to GND and has a negligible difference in the reactive voltage between loop segments comprising the antenna conductor. The result is that capacitive leakage currents to the external environment and between loop segments are significantly reduced. Antenna efficiency is correspondingly increased as greater flux generation is achieved. Furthermore, sensitivity to grounded conductors in the surrounding environment is reduced because the undesired radiation from the parasitic capacitive antenna effect is reduced on account of the reduced capacitive leakage currents. Moreover, by placing substantially one half of the capacitive reactance in between loop segments as opposed to at the respective ends of the antenna wire, the ESR attributed to tuning capacitors is reduced thereby also contributing to improved antenna efficiency. In summary, the small loop antenna is balanced and fully optimized in accordance with one embodiment of the present invention.

Figure 5A:
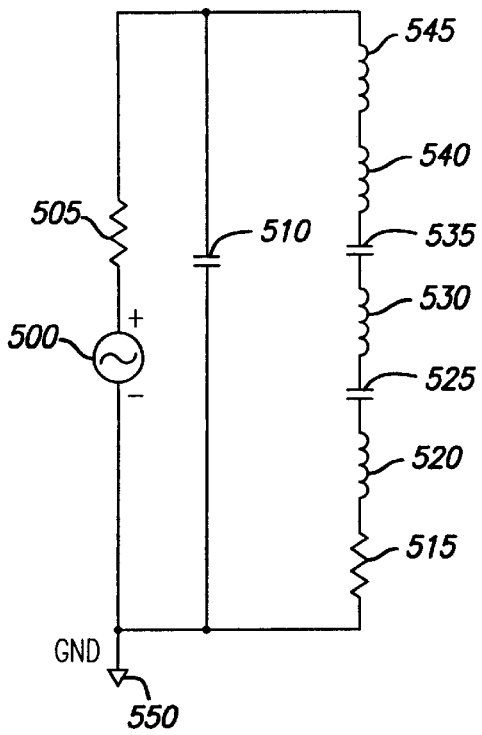
FIG. 5*a* is an electrical schematic of one embodiment of an antenna matching circuit in accordance with the present invention.

FIG. 5*a* is an electrical schematic of an antenna matching circuit in accordance with the present invention. In this particular embodiment, the antenna is comprised of a four turn loop comprised of loop turn 520, loop turn 530, loop turn 540 and loop turn 545. Each turn is referred to as a loop segment or a loop turn. Resistor 515 represents the serial resistance of the antenna wire. Capacitor 525, capacitor 535 and capacitor 510 are selectively placed as shown. Specifically, capacitor 525 is serially connected between loop segment 520 and loop segment 530. Capacitor 535 is serially connected between loop segment 530 and loop segment 540. Capacitor 510 is serially connected between loop segment 520 and loop segment 545 (across the antenna). Source 500 and source resistance 505 are provided to energize the circuit. This embodiment may be implemented on a PCB where loop segment 520 and loop segment 530 are on one side of the PCB, and loop segment 540 and loop segment 545 are on the other side of the PCB. Loop segment 520 and loop segment 545 are adjacent to each other through the PCB, while loop segment 530 and loop segment 540 also are adjacent to each other through the PCB. Other configurations or winding structures are possible. This embodiment is merely provided as an example, and those skilled in the art will appreciate the broad range of configurations covered by the present invention. The capacitor values are selected so that the corresponding adjacent turns on opposite sides of the PCB will have substantially the same reactive voltages thereby canceling parasitic capacitances.

Figure 5B:
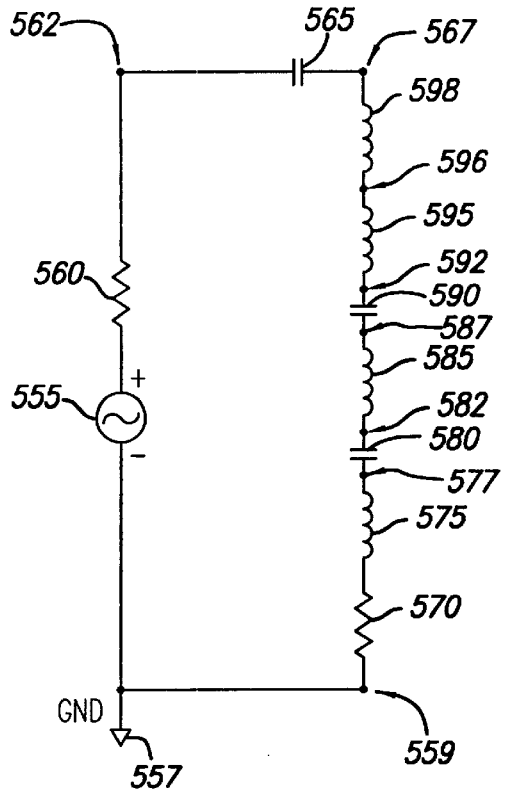
FIG. 5*b* shows the Thevenin equivalent circuit of the antenna matching circuit shown in FIG. 5*a*.

FIG. 5*b* shows the Thevenin equivalent circuit of the antenna matching circuit shown in FIG. 5*a*. The parallel components of capacitance 510 and resistance 505 shown in FIG. 5*a* are transformed into a complex impedance containing resistance 560 and capacitance 511 (capacitance 511 not shown) which are connected in series with source 555, the Thevenin equivalent of source 500. Capacitance 511, capacitance 525 and capacitance 535 are serial to each other and thus can be symbolized as a single capacitive reactance as previously explained. However, rather than represent their aggregate serial capacitance as one capacitance, it is distributed into three serial capacitances represented by capacitance 580, capacitance 590 and capacitance 565 as shown in FIG. 5*b*. Those skilled in the art will recognize that capacitance 565 of FIG. 5*b* is the Thevenin transformation of capacitor 510 of FIG. 5*a*, and capacitances 590 and 580 of FIG. 5*b* represent capacitors 535 and 525, respectively, of FIG. 5*a*.

In this embodiment, capacitance 590 and capacitance 565 are substantially equal in value, each having a capacitance twice that of capacitance 580. Note, however, that capacitance 580 represents substantially one half of the capacitive reactance of the antenna matching circuit. It follows then, that capacitance 580 also matches one half of the inductive reactance of the antenna conductor. Also note that approximately 75% of the capacitive reactance of the antenna matching circuit has been placed inside the antenna. Specifically, capacitance 590 is placed between loop turns 595 and 585, and cancel 25% of the inductive reactance of the antenna conductor. Also, capacitance 580 is placed between loop turns 585 and 575, and cancels 50% of the inductive reactance of the antenna conductor. Generally, such selection of capacitance 580, capacitance 590 and capacitance 565 ensures that the antenna voltage will not only be balanced about GND, but also will have zero voltage difference between the loop segments (for example, between loop segments adjacent each other but on opposite layers of a PCB). The embodiment disclosed in FIG. 5*a* provides a non-symmetrical voltage distribution about Vavg, but as can be seen, symmetry is not necessary to achieve an antenna balanced about GND and optimized for parasitic capacitances in accordance with the present invention.

Referring to FIG 5*b*, voltage 559 represents the voltage between the GND 557 side of loop segment 575 and source 555. Voltage 577 is the voltage between the other side of loop segment 575 and capacitance 580. Voltage 582 is the voltage between the other side of capacitance 580 and one side of loop segment 585. Voltage 587 is the voltage between the other side of loop segment 585 and capacitance 590. Voltage 592 is the voltage between one side of loop segment 595 and the other side capacitance 590. Voltage 596 represents the voltage on the other side of loop segment 595 and one side of loop segment 598. Voltage 567 represents the voltage between the other side of loop segment 598 and capacitance 565. Voltage 562 represents the voltage between the other side of capacitance 565 and resistance 560.

Figure 5C:
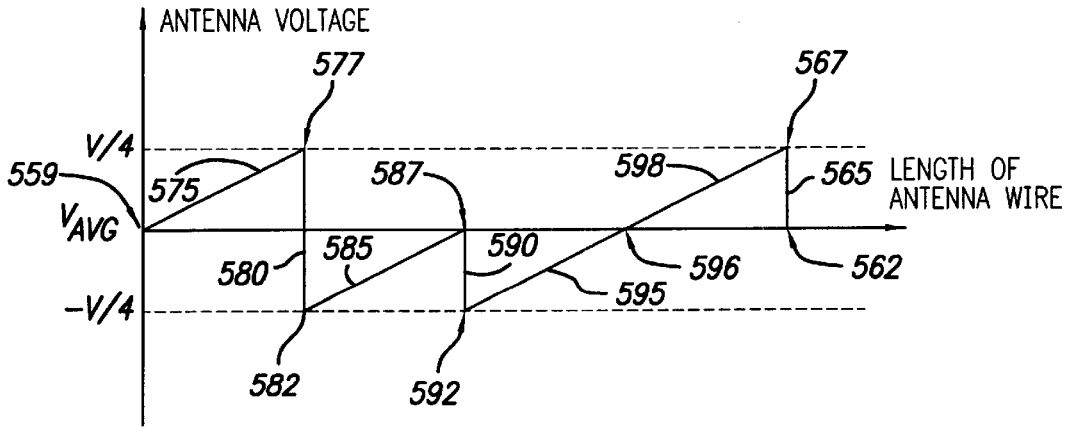
FIG. 5*c* is an antenna voltage distribution graph of the antenna matching circuit shown in FIG. 5*b*.

FIG. 5*c* is an antenna voltage distribution graph of the antenna matching circuit shown in FIG 5*b*. Voltage 559 is at GND 557. The reactive voltage across loop segment 575 is the difference between voltage 577 and voltage 559. However, because voltage 559 is GND 557, the equation can be simplified to voltage 577, which represents the maximum positive voltage on the antenna. The four turn loop antenna wire is broken into loop segment 575, loop segment 580, loop segment 595 and loop segment 598 which comprise the length of the antenna wire or radiating surface. Each of the loop segments represents one turn of the loop. As the distance along the antenna wire increases, the antenna voltage linearly increases as well until voltage 577, where capacitance 580 provides a polarity change. More specifically, the capacitive reactance of capacitance 580 is twice the magnitude of the inductive reactance of loop segment 575. As a result, the difference between voltage 577 and voltage 582 is substantially twice as much as the difference between voltage 577 and voltage 559.

The voltage across loop segment 585 is the difference between voltage 582 and voltage 587. Voltage 587 is zero because capacitance 580 was chosen to give twice the reactance of loop segment 575, and because the loop segments 575 and 585 are equal in length and reactance. Thus, the voltage across loop segment 585 is voltage 582, which represents the maximum negative voltage on the antenna. As the distance along the is portion of the antenna wire comprising loop segment 585 increases, the antenna voltage linearly increases as well until voltage 587, where capacitance 590 provides another polarity change. More specifically, the capacitive reactance of capacitance 590 is substantially equal to the magnitude of the inductive reactance of loop segment 585. As a result, the difference between voltage 587 and voltage 582 is substantially equal to the difference between voltage 587 and voltage 592.

The voltage across loop segment 595 is the difference between voltage 592 and voltage 596. Voltage 596 is zero because capacitance 590 was chosen to give substantially the same reactance of loop segment 585, and because the loop segments 585 and 595 are equal in length and reactance. Thus, the voltage across loop segment 595 is voltage 592, which is substantially equal to voltage 582. As the distance along the portion of the antenna wire comprising loop segment 595 increases, the antenna voltage linearly increases as well until voltage 596, where the portion of the antenna wire comprising loop segment 598 begins. Because there is no tuning capacitor to cause a polarity change, the antenna voltage continues to linearly increase as the distance along loop segment 598 increases until voltage 567, where capacitor 565 provides a third polarity change. More specifically, the capacitive reactance of capacitance 565 is substantially equal to the magnitude of the inductive reactance of loop segment 598. As a result, the difference between voltage 567 and voltage 596 is substantially equal to difference between voltage 567 and voltage 562. This follows in that both voltage 596 and voltage 562 are effectively GND.

Although the voltage distribution graph of the embodiment shown in FIG. 5*c* is not symmetrical as is the graph of FIG. 4*c*, each graph depicts an antenna matching circuit having similar qualities. For instance, in both cases, the average reactive voltage (Vavg) of the antenna, or the balancing point of the antenna is substantially GND. Also, the reactive voltage difference between adjacent loop segments within each antenna is substantially 0 volts. Thus, both embodiments are balanced about GND and fully optimized against parasitic capacitive radiation in accordance with the invention.

Figure 5D:
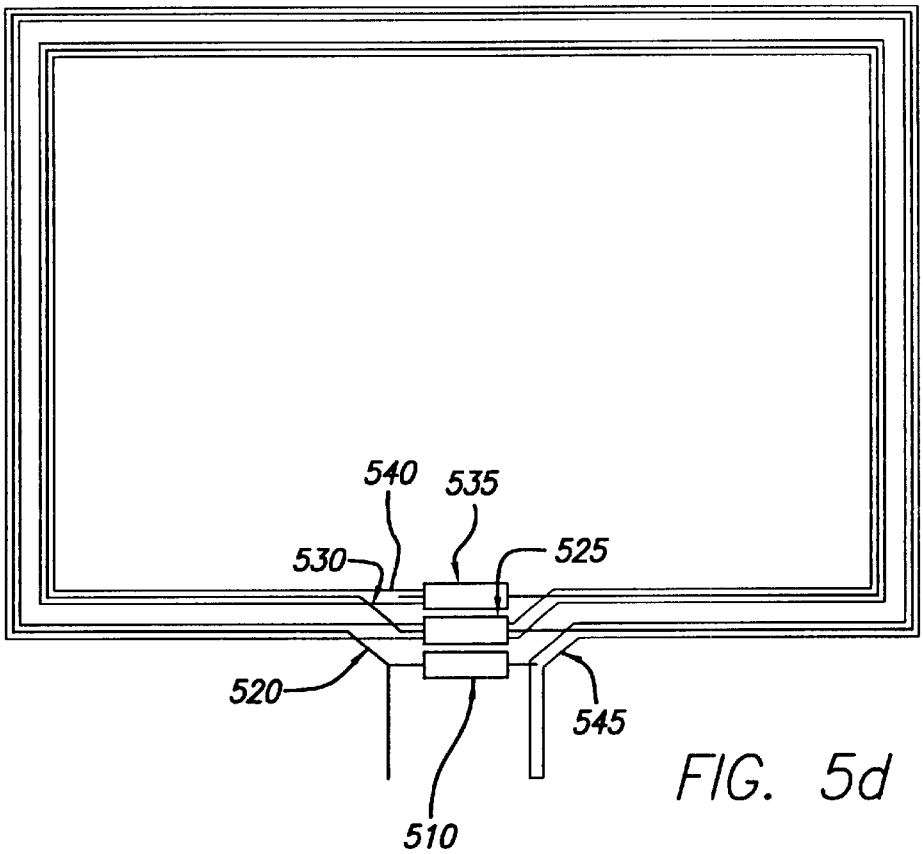
FIG. 5*d* shows a possible physical implementation for the loop antenna shown in FIG. 5*a*.

FIG. 5*d* shows a possible physical implementation for the loop antenna shown in FIG. 5*a*. The embodiment shown is a four turn, two layer printed loop antenna. Three capacitors, 510, 525 and 535, are used for the impedance matching. The specific geometric dimensions of the printed loop antenna are not relevant. In addition, the trace widths were chosen for drawing readability and may be varied in the actual implementation. The winding structure has loop turn 520 and loop turn 545 adjacent to each other through the PCB, and loop turn 530 and loop turn 540 adjacent to each other through the PCB. Loop turn 520 is on the same layer of the PCB as loop turn 530. Loop turn 540 is on the same layer of the PCB as loop turn 545. The performance characteristics of this embodiment are represented by the voltage distribution graph of FIG. 5*c* as explained above.

Figure 8A:
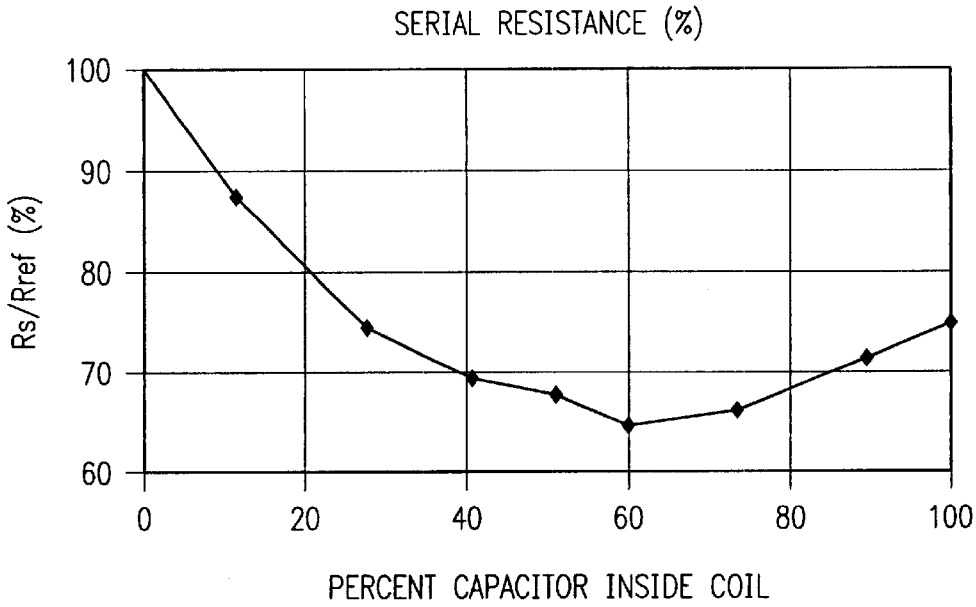
FIG. 8*a* is a graph showing the effect of placing a percentage of the tuning capacitance inside the antenna on the serial resistance of the antenna.

FIG. 8*a* is a graph showing the effect of placing a percentage of the tuning capacitance inside the antenna on the serial resistance of the antenna. The Y-axis of the graph represents the percentage the change in serial resistance of the antenna with reference to the total series resistance of the antenna. The X-axis represents the percentage of the serial tuning capacitance placed inside the antenna. As can be seen, the antenna serial resistance is minimized by approximately 35% when about 60% of the total serial capacitance is inside the antenna (for example, between a first and a second loop turn of a multiple loop turn antenna). This 35% reduction in antenna serial resistance translates to a 35% increase in antenna efficiency.

Figure 8B:
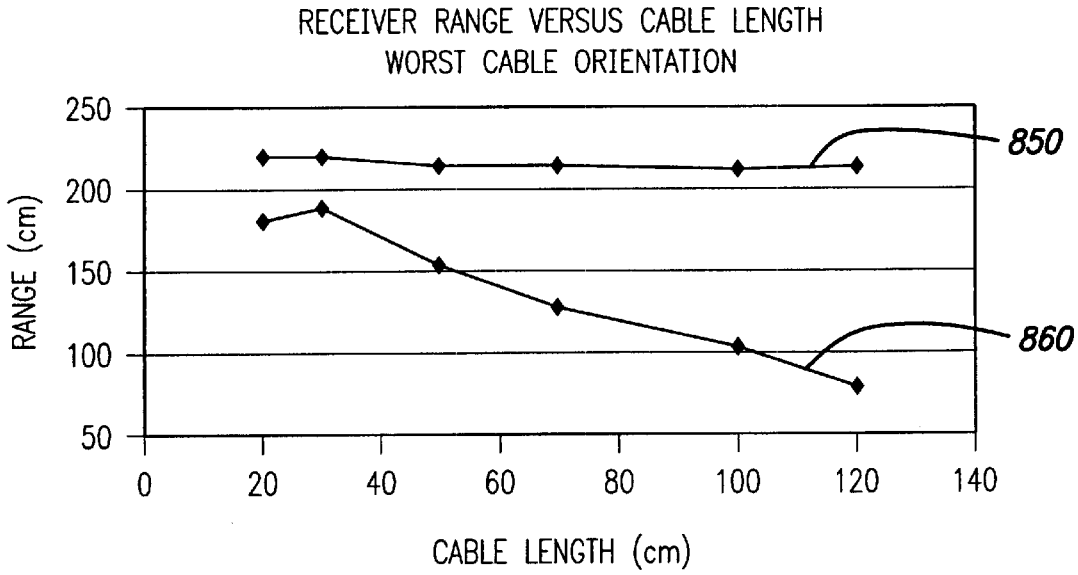
FIG. 8*b* is a comparison graph showing the impact of cable length on the range of a receiver unit having an antenna that has been balanced and optimized in accordance with the present invention, and the impact of cable length on the range of a receiver unit having a conventional antenna.

FIG. 8*b* is a comparison graph showing the impact of cable length on the range of a receiver unit having an antenna that has been balanced and optimized in accordance with the present invention (850), and the impact of cable length on the range of a receiver unit having a conventional antenna (860). The orientation of the cable of each receiver unit was configured for maximum interference by the parasitic capacitive antenna of the receiver antenna. As can be seen, the range of the receiver unit employing the present invention is almost immune to cable length because the parasitic capacitive antenna has been neutralized (850). In contrast, the receiver unit employing the conventional antenna suffers a reduction of approximately 100 cm in the effective range of the receiver due to the parasitic capacitive antenna (860). Thus, the range of an antenna that is balanced and optimized in accordance with the present invention is practically independent of the environment conditions such as cable orientation. The reliability of the antenna link is therefore significantly improved.

The foregoing description of the embodiments of the invention has been presented for the purposes of illustration and description. It is not intended to be exhaustive or to limit the invention to the precise form disclosed. Many modifications and variations are possible in light of the above teaching as will be understood by those skilled in the art. For instance, various antenna applications can benefit from the present invention, whether implemented on PCB or more conventional means such as wire wound inductor type antennas. Furthermore, whether the antenna is a single loop antenna or a multiple loop antenna of any number of turns, the principles of the present inventions can be applied as taught herein because the examples provided can be extrapolated so as to apply to any number of turns. Moreover, the principle of the present invention can be applied to both transmitting and receiving antennas. It is intended that the scope of the invention be limited not by this detailed description, but rather by the claims appended hereto.

What is claimed is:

1. A method for optimizing the performance of a loop antenna that is functioning at its operating frequency, the loop antenna having an inductive reactance, and a conductor having a first loop segment and a second loop segment, and where a total capacitive reactance needed to match the inductive reactance of the loop antenna is predetermined, the method comprising:

distributing a portion of the total capacitive reactance serially between the first loop segment and the second loop segment of the conductor of the loop antenna, thereby leaving a remaining portion of the total capacitive reactance; and distributing the remaining portion of the capacitive reactance across the conductor of the loop antenna.

2. The method of claim 1 wherein distributing the portion of the total capacitive reactance serially between the loop segments of the antenna further comprises:

selecting a capacitor that provides the portion of the total capacitive reactance;

determining a position of the capacitor on the conductor; and connecting the capacitor at the determined position.

3. The methods of claim 2 wherein determining the position of the capacitor on the comductor further comprises:

placing the capacitor along the conductor of the antenna at a distance from one end of the conductor, the distance determined by the formula $$x=[1-(w^2*L_a*C_x)/2]*L,$$

where x is the distance, L is a total length of the conductor, w is 2*PIE*operating frequency, $L_a$ is a inductor value associated with the conductor, and $C_x$ is a value of the capacitor.

4. The method of claim 1 wherein the conductor of the loop antenna has a reactive voltage across it, and the distributing steps further comprise:

balancing the loop antenna about ground such that an average reactive voltage across the antenna is substantially zero volts.

5. The method of claim 4 wherein balancing the antenna about ground comprises:

providing a polarity change that causes substantially one half of the reactive voltage across the conductor of the loop antenna to be positive, and substantially one half of the reactive voltage across the conductor of the loop antenna to be negative.

6. A method for optimizing the performance of a loop antenna that is functioning at its operating frequency, the loop antenna having an inductive reactance, and a conductor having a first loop segment and a second loop segment, each loop segment having an inner end and an outer end, where a total capacitive reactance needed to match the inductive reactance of the loop antenna is predetermined, the method comprising:

distributing a portion of the total capacitive reactance serially between the inner end of the first loop segment and the inner end of the second loop segment, thereby leaving a remaining portion of the total capacitive reactance, wherein the reactance of the portion between the loop segments is substantially equal to one half of the inductive reactance;

dividing the remaining portion of the capacitive reactance into a first sub-portion, a second sub-portion, and a third sub-portion, wherein the reactance of the third sub-portion is substantially equal to one quarter of the inductive reactance;

connecting the second sub-portion serially along the outer end of the first loop segment of the conductor;

connecting the third sub-portion serially along the outer end of the second loop segment of the conductor; and connecting the first sub-portion across the serial connection of the second sub-portion, the first loop segment, the portion of the capacitive reactance between the inner ends of the first and second loop segments, the second loop segment, and the third sub-portion.

7. A method for optimizing the performance of a loop antenna having a first loop turn, and second loop turn that is adjacent to the first loop turn, the method comprising:

adjusting a reactive voltage at a point of the first loop turn to match a reactive voltage at a corresponding adjacent point of the second loop turn so that a reactive voltage difference between the two points is substantially zero.

8. The method of claim 7 wherein adjusting the reactive voltage further comprises:

providing a polarity charge between the first and second loop turns so that the first loop turn has a starting voltage that is substantially equal to the starting voltage of the second loop turn.

9. The method of claim 7, wherein the first loop turn and the second loop turn have substantially similar lengths, the adjusting comprising:

adjusting a plurality of reactive voltages, each one associated with a point along the length of the first loop turn so that each reactive voltage of the first loop turn is substantially equal to a reactive voltage associated with a corresponding adjacent point along the second loop turn resulting in a reactive voltage difference between the corresponding points of the first and second loop turns of substantially zero.

10. A method for optimizing the performance of a loop antenna that is functioning at its operating frequency, the loop antenna having and inductive reactance, and a conductor having a first loop segment and a second loop segment, and where a capacitor reactance needed to cancel the inductive reactance of the loop antenna is predetermined, the method comprising:

distributing the capacitive reactance in the form of a first capacitor, a second capacitor, and a third capacitor, where the reactance of the third capacitor is substantially equal to one half of the inductive reactance;

connecting the second capacitor serially along an outer end of the first loop segment of the conductor;

connecting the third capacitor serially along an outer end of the second loop segment of the conductor; and connecting the first capacitor across the serial connection of the second capacitor, the first loop segment, the second loop segment, and the third capacitor.

11. A loop antenna circuit comprising:

a conductor having a first loop segment and a second segment, each loop segment having an inner end and an outer end, the conductor having an inductive reactance and a reactive voltage across it, the conductor for either receiving or generating radiation information;

a first capacitive reactance connected serially between the inner ends of the first and second loop segments of the conductor, the first capacitive reactance for providing a first reactive voltage that is substantially equal in magnitude to, and substantially 180 degrees out-of-phase with, a first component of the reactive voltage across the conductor thereby leaving a remaining component of the reactive voltage across the conductor; and a second capacitive reactance connected across the outer ends of the first and second loop segments, the second capacitive reactance for providing a second reactive voltage that is substantially equal in magnitude to, and substantially 180 degrees out-of-phase with, the remaining component of the reactive voltage across the conductor.

12. A loop antenna circuit comprising:

a conductor having a first loop segment and a second loop segment, each loop segment having an inner end and an outer end, the conductor having an inductive reactance and a reactive voltage across it, the conductor for either receiving or generating radiation information;

a first capacitive reactance connected serially between the inner ends of the first and second loop segments, the first capacitive reactance for providing a first reactive voltage that is substantially equal in magnitude to, and substantially 180 degrees out-of-phase with, a first component of the reactive voltage across the conductor thereby leaving a remaining component of the reactive voltage across the conductor;

a second capacitive reactance connected serially along the outer ends of the first loop segment of the conductor;

a third capacitive reactance connected serially along the outer end of the second loop segment of the conductor; and a fourth capacitive reactance connected across the serial combination of the second capacitive reactance, the first loop segment, the first capacitive reactance, the second loop segment and the third capacitive reactance.

13. The antenna matching circuit of claim 12 wherein the first capacitive reactance is substantially equal to one half of the inductive reactance, and the third capacitive reactance is substantially equal to one quarter of the inductive reactance.

14. A loop antenna circuit comprising:

a conductor having a reactive voltage across it, and a plurality of loop segments, where a first loop segment and a second loop segment are adjacent to each other, the conductor being for either receiving of generating radiation information; and a capacitive reactance that has a reactive voltage equal to, and 180 degrees out of phase with, a portion of the reactive voltage across the conductor, the capacitive reactance being serially connected between the first loop segment and the second loop segment.

15. The loop antenna circuit of claim 14 wherein the reactive voltage of the capacitive reactance is substantially equal to, and 180 degrees out of phase with, a reactive voltage across either of the first or second loop segments.

16. A method for optimizing the performance of a loop antenna that is functioning at its operating frequency, the loop antenna having an inductive reactance, and a conductor having a plurality loop segments that comprise a length of the conductor, the method comprising:

connecting each one of a number of capacitors serially between a corresponding pair of adjacent loop segments of the plurality of loop segments, each capacitor having a reactive voltage that is substantially equal to a portion of a reactive voltage on the conductor.

17. The method of claim 16 wherein the capacitors have a combined capacitive reactance equal to a portion of a total capacitive reactance needed to cancel the inductive reactance of the loop antenna thereby leaving a remaining portion.

18. The method of claim 17 further comprising:

distributing the remaining portion of the capacitive reactance across the conductor of the loop antenna.

19. The method of claim 17 wherein the conductor has a first end and a second end, and the combined capacitive reactance of the capacitors is substantially equal to one half of the inductive reactance, the method further comprising:

dividing the remaining portion of the capacitive reactance into a first sub-portion, a second sub-portion, and a third sub-portion, wherein the reactance of the third sub-portion is substantially equal to one quarter of the inductive reactance;

connecting the second sub-portion serially along the first end of the conductor;

connecting the third sub-portion serially along the second end of the conductor; and connecting the first sub-portion across the serial connection of the second sub-portion, the conductor, and the third sub-portion.

20. A method for optimizing the performance of a loop antenna having a conductor having a first loop segment and a second loop segment, each loop segment having an inner end and an outer end, the method comprising:

providing a polarity change between the inner ends of the first and second loop segments.

* * * * *

UNITED STATES PATENT AND TRADEMARK OFFICE

CERTIFICATE OF CORRECTION

PATENT NO. : 6,359,594 B1 
DATED : March 19, 2002
INVENTOR(S) : Philippe Junod

It is certified that error appears in the above-identified patent and that said Letters Patent is hereby corrected as shown below:

Title page,
Item [56], References Cited,
FOREIGN PATENT DOCUMENTS, delete reference "JP 7-99345 4/1995"
OTHER PUBLICATIONS, delete reference "Translation of Tadatsu JP 5-152609/1993."

Column 17,
Line 44, change "methods" to -- method --;
Line 45, change "comductor" to -- conductor --;
Line 49, after "formula" insert -- : --;
Line 54, before "inductor" change "a" to -- an --.

Column 18,
Line 33, after "and" insert -- a --.
Line 41, change "charge" to -- change --.
Line 58, before "inductive" change "and" to -- an --;
Line 61, change "capacitor" to -- capacitive --.

Column 19,
Line 45, change "ends" to -- end --.

Column 20,
Line 18, after "plurality" insert -- of --.
Line 39, change "wherein" to -- where --.

Signed and Sealed this

Ninth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,359,594 B1
APPLICATION NO. : 09/452567
DATED : March 19, 2002
INVENTOR(S) : Philippe Junod It is certified that error appears in the above-identified patent and that said Letters Patent is hereby corrected as shown below:

In the Specification, Column 8, line 40, please delete “and”.

In the Claims, Claim 13, Column 19, line 54, delete “matching” and insert --loop-- after the word “The”.

Signed and Sealed this

Tenth Day of July, 2007

JON W. DUDAS
*Director of the United States Patent and Trademark Office*